US006908213B1

(12) United States Patent
Goodman

(10) Patent No.: US 6,908,213 B1
(45) Date of Patent: Jun. 21, 2005

(54) HOLIDAY LIGHTS COMPACTING SYSTEM

(76) Inventor: Matthew David Goodman, 3303 West St., Ames, IA (US) 50014

( * ) Notice: Subject to any disclaimer, the term of this patent is extended or adjusted under 35 U.S.C. 154(b) by 96 days.

(21) Appl. No.: 10/636,760

(22) Filed: Aug. 7, 2003

Related U.S. Application Data

(63) Continuation-in-part of application No. 10/078,100, filed on Feb. 19, 2002, now abandoned.

(51) Int. Cl.[7] ..... F21V 21/14; F21V 21/36
(52) U.S. Cl. ..... 362/232; 362/391; 362/250
(58) Field of Search ..... 362/232, 234, 362/227, 391, 387, 253, 258, 249, 250

(56) References Cited

U.S. PATENT DOCUMENTS 3,384,227 A * 5/1968 Spatz ..... 362/249
4,971,200 A * 11/1990 Huang et al. ..... 362/249
5,033,619 A * 7/1991 Garis ..... 206/419
5,541,818 A * 7/1996 Ng et al. ..... 362/123
5,907,945 A * 6/1999 Doyle ..... 206/419
6,267,342 B1 * 7/2001 Huang ..... 362/391
6,561,673 B2 * 5/2003 Frederick ..... 362/234

* cited by examiner

*Primary Examiner*—Sandra O'Shea
*Assistant Examiner*—Bao Q. Truong
(74) *Attorney, Agent, or Firm*—James C. Nemmers

(57) ABSTRACT

The present invention is a system for: storing holiday light strings. The light string storage system changes the production of typical light strings by attaching a cylinder to every light socket and running a lead through each cylinder. Pulling on the lead while grasping a socket causes the cylinders to couple and the bulbs to be in an upright, compact, and orderly manner for convenient and easy storage.

23 Claims, 4 Drawing Sheets

HOLIDAY LIGHTS COMPACTING SYSTEM

This is a continuation in part of U.S. patent application Ser. No. 10/078,100 filed on Feb. 19, 2002 now abandoned.

BACKGROUND OF THE INVENTION

Light strings are a traditional western method of celebrating the winter holiday season and have recently begun to be used in celebrations of all kind. There has been however, a problem regarding easy seasonal storage of these lights. Tangles often lead to breakage of bulbs and inconvenience. Storage methods have been developed, but often these are as inconvenient as the untangling they are trying to prevent. There is a need for a light string storage system which is convenient and allows for years of hassle free enjoyment. The present invention is designed to address the forgoing concerns.

It is an object of the present invention to provide a mechanism for the storage of light strings. It is another object of the present invention to provide a storage mechanism for light strings that allows one to organize the light strings in such a way that they may be stored easily and compactly for years to come. It is a further object of the invention to provide a storage mechanism that is not painstakingly laborious, but instead quick and convenient. It is yet another object of the present invention to yield a change in the convenience of storing holiday lights through change in their physical production.

SUMMARY OF THE INVENTION

The present invention is a system for the storage of holiday light strings. Attached to each ordinary light socket is a cylinder with an opening and two complementary shaped ends. A lead is attached to the socket furthest on the string from the electrical plug and runs through the opening on every cylinder. Pulling the lead's end near the electrical plug while grasping the first socket in the string causes the cylinders to quickly and conveniently couple along the span of the light string. The light string is then compact and orderly with all bulbs in an upright position ready to be easily stored until their next use.

DESCRIPTION OF THE PREFERRED EMBODIMENT

Figure 1:
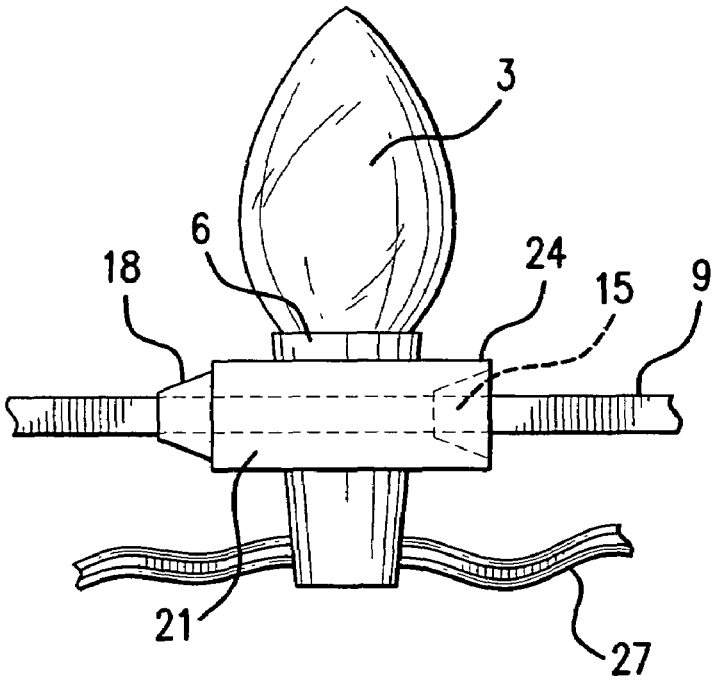
FIG. 1 is a side view of the preferred embodiment of the light string storage system's attachment to each individual socket.

The preferred embodiment of the holiday light string storage system can be seen in FIG. 1. The storage system requires a small change in the physical production of light strings. The typical light string consists of one or more wires 27 wound through a series of light sockets 6 with an electrical plug 30 at the beginning of the wires 27. The sockets 6 each receive a bulb 3 and are typically one-half inch to one and one-half inch in height measured from the wires 27 to the base of the bulb 3.

The present invention changes this typical structure in two ways. First, it adds a cylinder 21 to each socket 6. The cylinders 21 are perpendicularly attached to each socket 6. One skilled in the art would understand that the cylinder 21 could be manufactured from a number of materials including, but not limited to, metal, plastic, and glass. Although the cylinder 21 can be perpendicularly attached at any height on the socket 6 between the wires 27 and the bulb 3, in the preferred embodiment the cylinder 21 is attached at half the height of the socket 6. The cylinder 21 has front and rear ends designed in complementary shapes enabling each cylinder 21 to couple with the adjacent cylinders 21 on both sides on the light string. In the preferred embodiment, the cylinder 21 has ends consisting of a dome shaped end 18 and a hollow end 24. One skilled in the art would understand that the cylinder 21 could have ends of any shape so long as the shapes are capable of coupling and the shapes alternate on each end of the successive cylinders on the light string. In the preferred embodiment, the length of the cylinder 21 is equal to 1 or 1.5 times the width of the socket 6 at the point where the cylinder 21 is attached.

Figure 2:
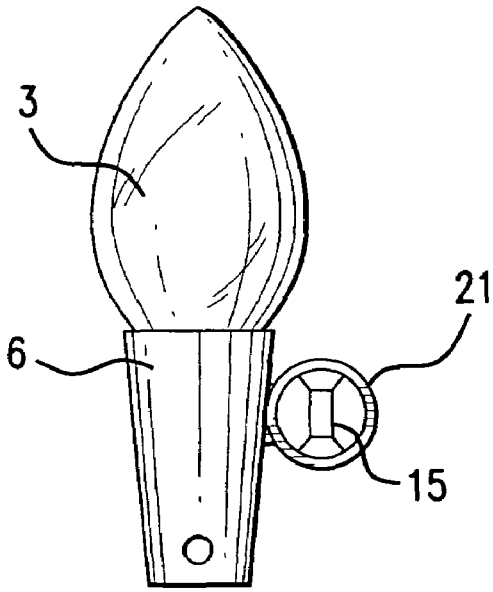
FIG. 2 is a rear view of the preferred embodiment of the light string storage system's attachment to each socket showing the opening in the guide.

The second change in the physical structure of the typical light string is that a lead 9 runs through the opening 15 which extends lengthwise through the cylinder 21 as can be seen in FIG. 2. One skilled in the art would understand that the lead 9 could be any number of materials including, but not limited to, wire, ribbon, string, twine, plastic, and nylon. In the preferred embodiment, the diameter of the opening 15 is five percent the diameter of the cylinder 21. The lead is attached to the last socket 6 on the string relative to the electrical plug 30 and extends the length of the string through the openings 15 in each cylinder 21. Although the lead 9 could be of any dimensions equal to or less than the dimensions of the opening 15, in the preferred embodiment the dimensions of the lead 9, and the opening 15 will differ only enough so that the lead 9 is slighter in size to permit the lead 9 to be threaded through the opening 15 such that the two are taut. Also in this embodiment, the opening 15 is rectangular and the lead 15 is of corresponding cross-sectional shape to assist in guiding the cylinder 21 into proper alignment for storage.

Figure 3:
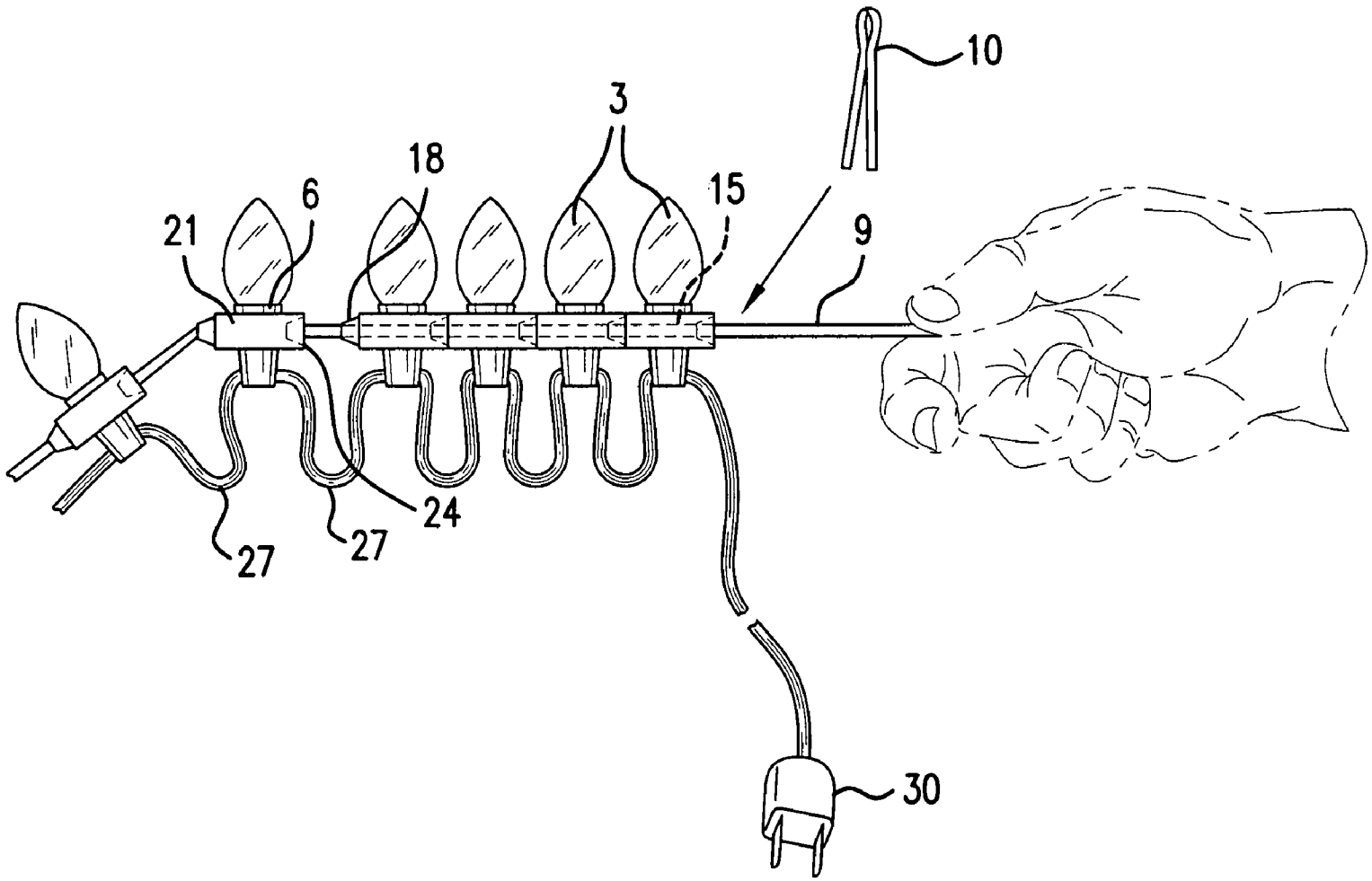
FIG. 3 is a side view of the preferred embodiment of the light string storage system illustrating the coupling of the cylinders as the lead is pulled.

Referring now to FIG. 3, when the light string is plugged in to the electrical outlet the lead 9 and cylinder 21 serve no function. However, when the light string is to be packaged or stored, the lead 9 may be pulled while pushing the socket 6 adjacent to the electrical outlet in the opposite direction. In the preferred embodiment, the domed end 18 of the cylinder 21 will couple with the hollowed end 24 of the adjacent cylinder 21 throughout the light string "compacting" the sockets 6 together in a uniform manner. Since the lead 9 is taut, all of the bulbs 3 will be rotated so that they are in an upright position when the light string is compacted. To keep the light string compact and the lead 9 pulled tight, a member 10, can be placed on the lead 9 directly beside the socket adjacent to the electrical plug 30 or by looping the excess of lead 9 between the first and last socket 6 on the light string. Examples of members to be used may include, but are not limited to, a clip, paperclip, or tie.

Figure 4:
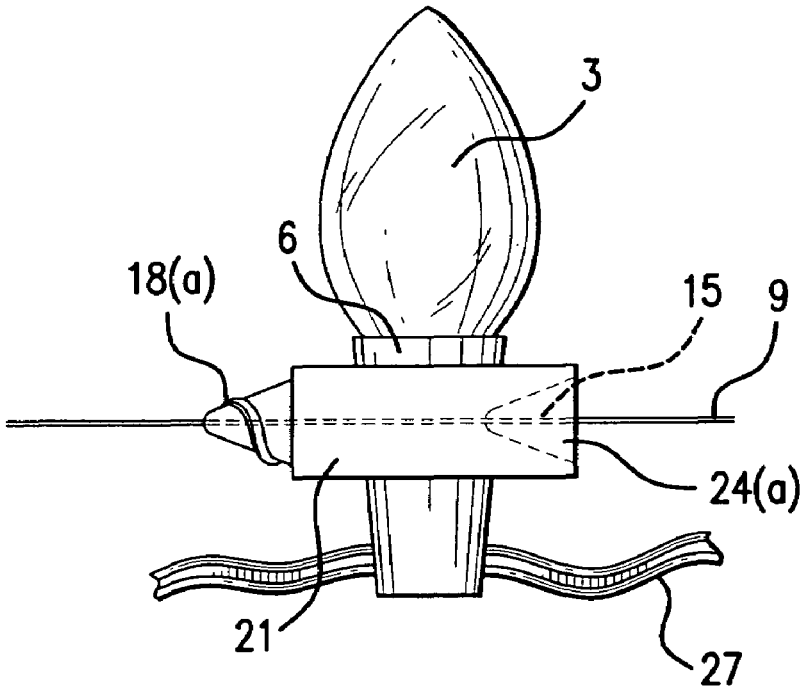
FIG. 4 is a side view of an alternate embodiment of the lights string storage system illustrating the thread pattern of the ends of the cylinder.
Figure 5:
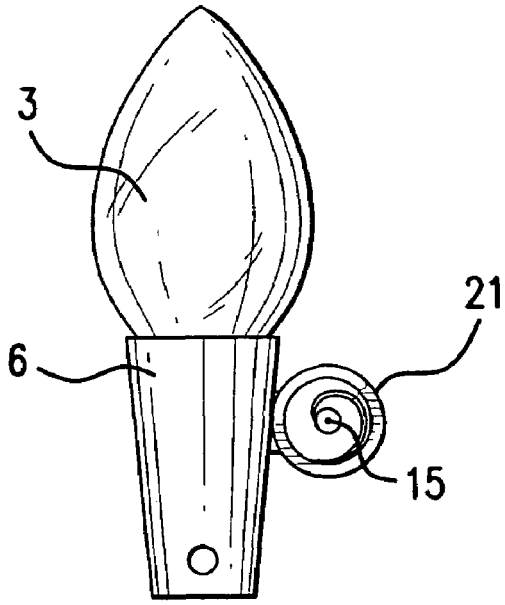
FIG. 5 is a rear view of an alternate embodiment of the light string storage system's attachment to each socket showing the opening in the guide.
Figure 6:
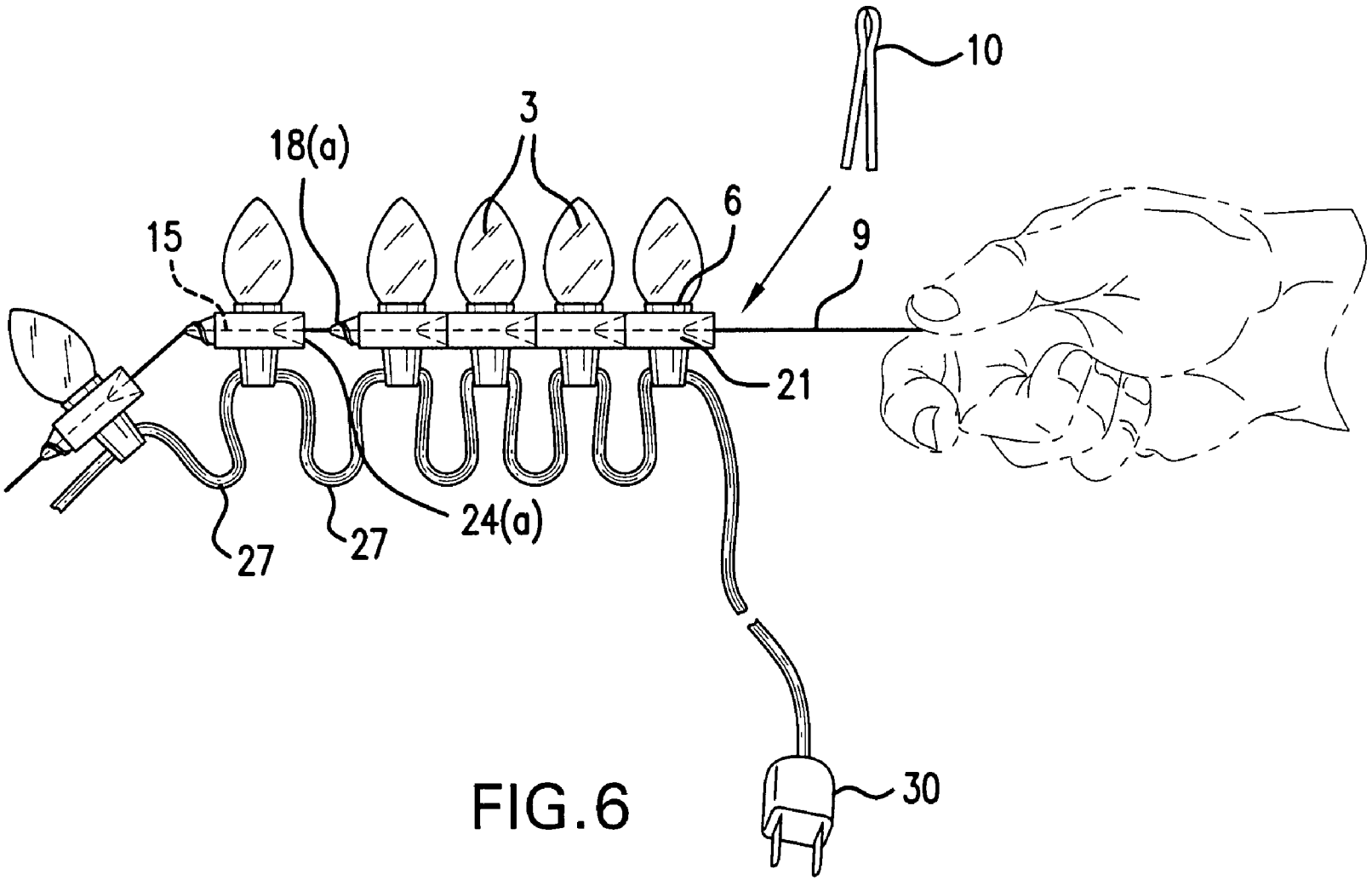
FIG. 6 is a side view of an alternate embodiment of the light string storage system illustrating the coupling of the cylinders as the lead is pulled.

Referring now to FIGS. 4–6, there is shown an alternate embodiment in which the same reference numeral is used to identify a part corresponding to a similar part of the first embodiment with the same numerals followed by (a). In this second embodiment, the cylinder 21 has front 18(*a*) and rear 24(*a*) ends with opposite thread patterns such that both ends of the cylinder 21 are able to screw into the adjacent end of the cylinders 21 attached to the bordering sockets 6 on the light string. As can be seen in FIG. 6, the light string is compacted by pulling on the lead 9 and grasping the first socket 6 on the light string by electrical plug 30. In this embodiment, sockets are kept in the compact formation because the front end 18(*a*) of the cylinders 21 will be screwed into the rear end 24(*a*) of the adjacent cylinders throughout the light string.

In all embodiments, the sockets 6 will then be aligned in a parallel row with the bulbs 3 positioned upright. The light string storage system 1 prevents the light string from tangling and breaking allowing for its easy use during the next holiday season. The addition to the light string of the cylinders 21 does not change the electrical engineering of the socket 6. Manufacture of the lights strings would differ only in shaping the socket 6 and threading the lead 9 through the opening 15 of the cylinders 21. Changing the plastic mold would incorporate the new shape of the cylinder 21 into the socket 6. The lead 9 could be run through the opening 15 with robotics or labor.

Having thus described the invention in connection with the preferred embodiments thereof, it will be evident to those skilled in the art that various revisions can be made to the preferred embodiment without departing from the spirit and scope of the invention. It is our intention however that all such revisions and modifications that are evident to those skilled in the art will be included within the scope of the following claims.

What is claimed is:

1. A light string storage system comprising:

a string of lights each individual light having a bulb and a socket;

a cylinder having a front end and a rear end said cylinder being attached to each of said sockets where said front and rear ends of said cylinder are complementary shapes to couple with the adjacent cylinders on said string;

an opening extending lengthwise through each cylinder; and a lead of at least the length of said string of lights extending through the opening in each cylinder on each light on said string, said lead being affixed to the socket at one end of said string and extending beyond the cylinder at the opposite end of said string whereby pulling said lead will cause said cylinder to couple.

2. The light string storage system of claim 1 wherein said front end of said cylinder is dome shaped and said rear end is hollow in shape.

3. The light string storage system of claim 2 wherein a member is placed on said lead to keep each of said cylinders coupled with the adjacent cylinders on said string.

4. The light string storage system of claim 2 wherein said lead is looped through the first and last socket on said string to keep each of said cylinders coupled with the adjacent cylinders on said string.

5. The light string storage system of claim 1 wherein said front end and said rear end have opposite thread patterns such that both of said ends are able to screw into the adjacent cylinders attached to the bordering sockets on said string.

6. The light string storage system of claim 1 wherein the length of said cylinder is equal to one or one and a half times the width of said socket at the point where said cylinder is attached to said socket.

7. The light string storage system of claim 1 wherein said cylinder is plastic.

8. The light string storage system of claim 1 wherein the color of said cylinder and said lead are identical in color to said sockets.

9. The light string storage system of claim 1 wherein said lead is ribbon.

10. The light string storage system of claim 1 wherein said lead is nylon.

11. The light string storage system of claim 1 wherein said lead is string.

12. A light string storage system comprising:

a string of lights each individual light having a bulb and a socket;

a cylinder having a front end and a rear end, said cylinder being attached to each of said sockets, where said front and rear ends of said cylinder are complementary shapes to couple with the adjacent cylinders on said string;

an opening lengthwise through said cylinder; and a lead of at least the length of said string extending through said opening in each cylinder on each light on said string, said lead being affixed to the last socket on the string, where the dimensions of said lead differ only enough that the dimensions of said opening to make said lead taut in said opening.

13. The light string storage system of claim 12 wherein said front end is dome shaped and said rear end is hollow in shape.

14. The light string storage system of claim 13 wherein a member is placed on said lead to keep each of said cylinders coupled with the adjacent cylinders on said string.

15. The light string storage system of claim 13 wherein said lead is looped through the first and last socket on said light string to keep each of said cylinders coupled with the adjacent cylinders on said string.

16. The light string storage system of claim 12 wherein said front and rear ends have opposite thread patterns such that both of said ends are able to screw into the adjacent cylinders attached to the bordering sockets on said light string.

17. The lights string storage system of claim 12 wherein said cylinder is attached to each of said sockets at the position equal to half the distance between the wires and said bulb.

18. The light string storage system of claim 12 wherein the length of said cylinder is equal to one or one and a half times the width of said socket at the point where said cylinder is attached to said socket.

19. The light string storage system of claim 12 wherein said cylinder is plastic.

20. The light string storage system of claim 12 wherein the color of said cylinder and said lead are identical in color to said sockets.

21. The light string storage system of claim 12 wherein said lead is ribbon.

22. The light string storage system of claim 12 wherein said lead is nylon.

23. The light string storage system of claim 12 wherein said lead is string.

* * * * *